US009109816B2

(12) United States Patent
Kantchev et al.

(10) Patent No.: US 9,109,816 B2
(45) Date of Patent: Aug. 18, 2015

(54) MECHANICAL SUBCOOLING OF TRANSCRITICAL R-744 REFRIGERATION SYSTEMS WITH HEAT PUMP HEAT RECLAIM AND FLOATING HEAD PRESSURE

(71) Applicants: Jordan Kantchev, Longueuil (CA); Gaétan Lesage, Blainville (CA)

(72) Inventors: Jordan Kantchev, Longueuil (CA); Gaétan Lesage, Blainville (CA)

(73) Assignee: SYSTEMES LMP INC., Laval, Québec (CA)

( * ) Notice: Subject to any disclaimer, the term of this patent is extended or adjusted under 35 U.S.C. 154(b) by 316 days.

(21) Appl. No.: 13/774,030

(22) Filed: Feb. 22, 2013

(65) Prior Publication Data

US 2014/0053583 A1 Feb. 27, 2014

Related U.S. Application Data

(60) Provisional application No. 61/602,276, filed on Feb. 23, 2012.

(51) Int. Cl.

| | |
|---|---|
| ***F25B 1/10*** | (2006.01) |
| ***F25B 1/00*** | (2006.01) |
| ***F25J 1/00*** | (2006.01) |
| ***F25B 6/04*** | (2006.01) |
| ***F25B 9/00*** | (2006.01) |
| ***F25B 40/00*** | (2006.01) |

(52) U.S. Cl.
CPC ... *F25B 1/10* (2013.01); *F25B 6/04* (2013.01); *F25B 9/008* (2013.01); *F25B 40/00* (2013.01); *F25B 2400/075* (2013.01); *F25B 2400/13* (2013.01); *F25B 2400/23* (2013.01)

(58) Field of Classification Search
CPC ..... F25B 6/04; F25B 9/008; F25B 40/00; F25B 1/10; F25B 2309/06
USPC ..... 62/510, 498
See application file for complete search history.

(56) References Cited

U.S. PATENT DOCUMENTS

| | | | | |
|---|---|---|---|---|
| 2007/0017240 | A1 * | 1/2007 | Shapiro | 62/228.1 |
| 2008/0011004 | A1 * | 1/2008 | Lesage et al. | 62/200 |
| 2008/0229769 | A1 * | 9/2008 | Takegami et al. | 62/175 |

* cited by examiner

*Primary Examiner* — Allen Flanigan
*Assistant Examiner* — Filip Zec
(74) *Attorney, Agent, or Firm* — Equinox IP; Franz Bonsang

(57) ABSTRACT

A transcritical R-744 refrigeration system with an energy efficiency ratio of a level comparable to that of refrigeration systems using common refrigerants by mechanically subcooling of the R-744 refrigerant. Mechanical subcooling increases the refrigeration capacity without increasing the power consumption of the refrigeration system's compressors. The compressors used to provide the refrigeration capacity for the subcooling process operate at much more favorable conditions, therefore have a very high energy efficiency ratio. The result is higher refrigeration capacity and lower power consumption.

16 Claims, 2 Drawing Sheets

MECHANICAL SUBCOOLING OF TRANSCRITICAL R-744 REFRIGERATION SYSTEMS WITH HEAT PUMP HEAT RECLAIM AND FLOATING HEAD PRESSURE

CROSS-REFERENCE TO RELATED APPLICATIONS

This application claims the benefits of U.S. provisional patent application No. 61/602,276 filed on Feb. 23, 2012, which is herein incorporated by reference.

TECHNICAL FIELD

The present disclosure concerns refrigeration systems, and more particularly to mechanical subcooling of transcritical R-744 refrigeration systems with heat pump heat reclaim and floating head pressure.

BACKGROUND

R-744 transcritical refrigeration systems are used in supermarkets to refrigerate or to maintain in frozen state perishable products, such as foodstuff.

However, a problem with conventional R-744 transcritical refrigeration systems consists mainly of their very low energy efficiency ratio (refrigeration capacity divided by consumed power).

For example, a R-744 transcritical refrigeration system operating at 21.2° F. evaporating temperature and gas leaving the gas cooler at 98.6° F. (ambient air temperature at 90° F.) will have an energy efficiency ratio of 6.09 while a R-507 refrigeration system operating under the same conditions will have an energy efficiency ratio of 10 which is almost 50% more efficient.

Accordingly, there is a need for a system and method for improving the energy efficiency ratio of transcritical R-744 refrigeration systems.

SUMMARY

It is an object of the present disclosure to provide an improved transcritical R-744 refrigeration system with a higher energy efficiency ratio.

It is a further object of the present disclosure to provide a transcritical R-744 refrigeration system with an energy efficiency ratio (EER) of a level comparable to that of refrigeration systems using R-717, R-507, R-404a and other common refrigerants by mechanically subcooling of the R-744 refrigerant.

Accordingly, the present disclosure provides a mechanical subcooling system for use with a transcritical R-744 refrigeration system having at least one compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one compressor to provide the R-744 vapors to the at least one first compressor and to receive compressed R-744 vapors from the at least one first compressor, a by-pass valve for maintaining a required flow of R-744 vapors through the first heat exchanger, and a first receiver for receiving the R-744 vapors from the first throttling device, the first receiver being operatively connected to at least one defrost compressor, the mechanical subcooling system comprising:

- a second heat exchanger operatively connected between the at least one first compressor and the cooler;

- a third heat exchanger and a second throttling device operatively connected between the first heat exchanger and a second receiver for the separation of R-744 vapors and liquid;
- a first pressure regulating valve for feeding R-744 vapors from the second receiver to the at least one first compressor;
- at least one second compressor for mechanically subcooling of R-744 vapors leaving the cooler through the third heat exchanger or for heat reclaim through the second heat exchanger; and
- a fourth heat exchanger operatively connected between the second receiver and the at least one second compressor.

The present disclosure further provides a transcritical R-744 refrigeration system including the above-described mechanical subcooling system.

The present disclosure also provides a method for improving the energy efficiency ratio of a transcritical R-744 refrigeration system having at least one compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one compressor to provide the R-744 vapors to the at least one first compressor and to receive compressed R-744 vapors from the at least one first compressor, a by-pass valve for maintaining a required flow of R-744 vapors through the first heat exchanger, and a first receiver for receiving the R-744 vapors from the first throttling device, the first receiver being operatively connected to at least one defrost compressor, the method comprising mechanically subcooling of the R-744 vapors leaving the cooler.

BRIEF DESCRIPTION OF THE FIGURES

Embodiments of the disclosure will be described by way of examples only with reference to the accompanying drawing, in which.

Similar references used in different Figures denote similar components.

DETAILED DESCRIPTION

Generally stated, the non-limitative illustrative embodiment of the present disclosure provides a transcritical R-744 refrigeration system with an energy efficiency ratio (EER) of a level comparable to that of refrigeration systems using R-717, R-507, R-404a and other common refrigerants by mechanically subcooling of the R-744 refrigerant. Mechanical subcooling increases the refrigeration capacity without increasing the power consumption of the refrigeration system's compressors. The compressors used to provide the refrigeration capacity for the subcooling process operate at much more favorable conditions, therefore have a very high energy efficiency ratio. The result is higher refrigeration capacity and lower power consumption.

R-744 Transcritical Refrigeration System

Figure 1:
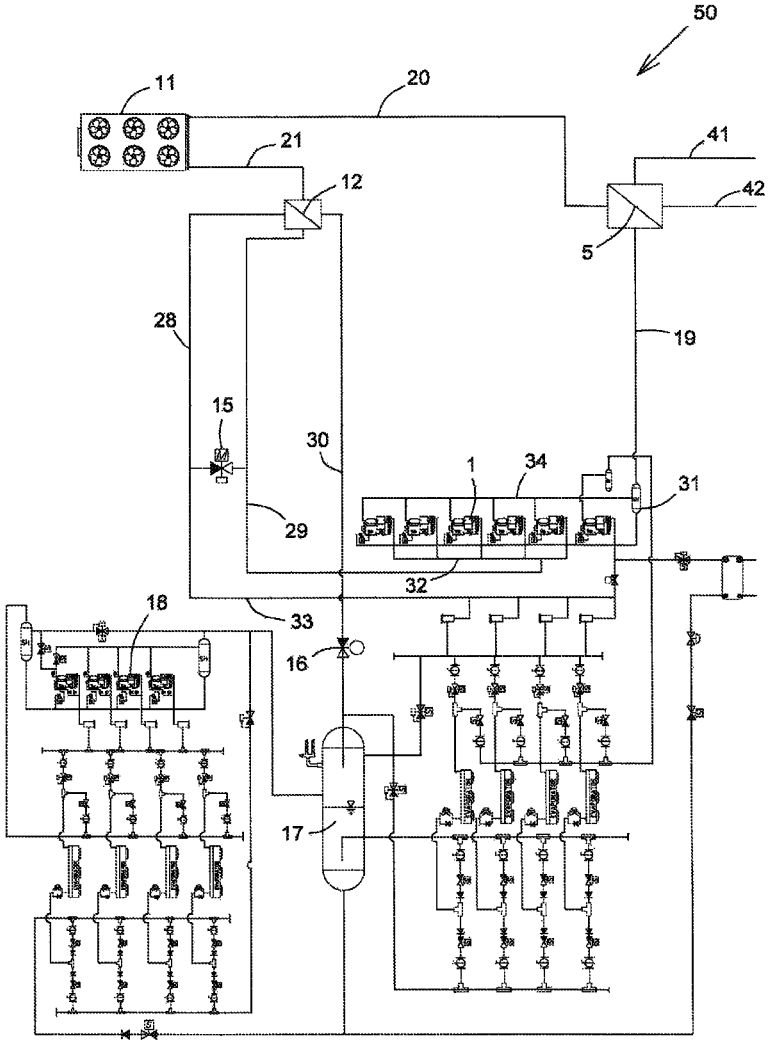
FIG.1 (PRIOR ART)
FIG. 1 is a schematic diagram of a typical transcritical R-744 refrigeration system.

Referring to FIG. 1, there is shown a typical R-744 transcritical refrigeration system 50. R-744 vapors are compressed by compressors 1 and directed through conduit 34, oil separator 31, conduit 19, heat exchanger 5 and conduit 20 to cooler 11, for example a gas cooler. The heat from the compressed R-744 vapors from compressors 1 is transferred in heat exchanger 5 to, for example, a glycol circulation system through conduits 41 and 42, to be used during the warm periods of the year for dehumidification purposes. From the cooler 11 the cooled transcritical R-744 vapors are directed through conduit 21, heat exchanger 12 and fed through conduit 30 to throttling device 16 where its pressure and temperature are reduced to a level required for the normal operation of the refrigeration system 50 both at low and medium temperatures and then is fed to receiver 17, which is operatively connected to defrost compressors 18. R-744 vapors from heat exchanger 12 are directed through conduit 29 and conduit 32 to the suction of compressors 1, which are connected through conduit 33 and conduit 28 to heat exchanger 12 where a heat transfer between R-744 vapors from the cooler 11 and the R-744 vapors from the suction of the compressors 1 takes place in order to insure stable suction temperature at a desired level. The by-pass valve 15 maintains the required flow of suction vapors through heat exchanger 12 in order to insure the required temperature of the suction vapors.

In order to increase the energy efficiency ratio (EER) of typical transcritical R-744 refrigeration systems, such as the transcritical R-744 refrigeration systems 50 in FIG. 1, to a level comparable to the EER of refrigeration systems using R-717, R-507, R-404a and other common refrigerants, mechanical subcooling of the R-744 refrigerant leaving the cooler 11 is introduced.

R-744 Transcritical Refrigeration System with Mechanical Subcooling

Figure 2:
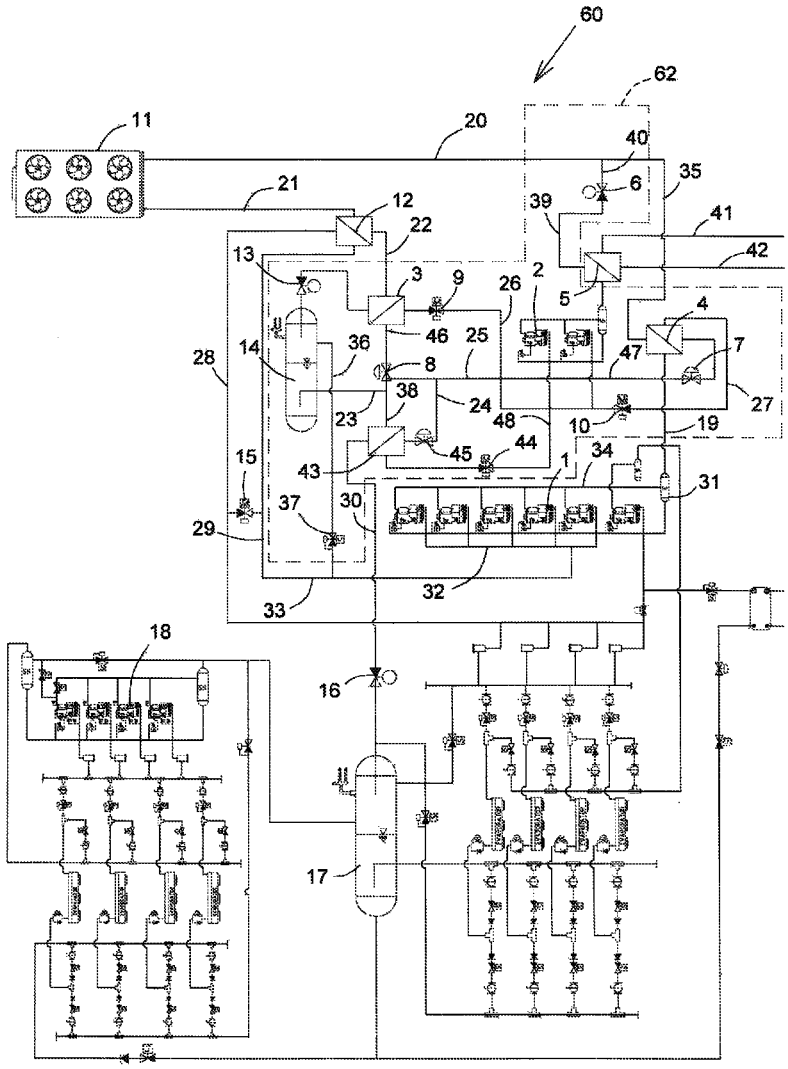
FIG. 2 is a schematic diagram of the transcritical R-744 refrigeration system of FIG. 1 with mechanical subcooling in accordance with an illustrative embodiment of the present disclosure.

Referring now to FIG. 2, there is shown a transcritical R-744 refrigeration system with mechanical subcooling 60 in accordance with an illustrative embodiment of the present disclosure, which is basically the transcritical R-744 refrigeration system 50 of FIG. 1 to which mechanical subcooling 62 is added. The R-744 vapors compressed by compressors 1 are directed through conduit 34, oil separator 31, conduit 19, heat exchanger 4, conduit 35 and conduit 20 to cooler 11. From the cooler 11 the cooled transcritical R-744 vapors are directed through conduit 21, heat exchanger 12, conduit 22, heat exchanger 3 and throttling device 13 to receiver 14 where a separation of R-744 vapors and liquid occurs. The R-744 vapors from receiver 14 are fed through conduit 36 and pressure regulating valve 37 to conduit 33 and to conduit 32, and to the suction of compressors 1. The suction of compressors 1 is connected through conduit 33 and conduit 28 to heat exchanger 12 where a heat transfer between R-744 vapors from the cooler 11 and the R-744 vapors from the suction of the compressors 1 take place in order to insure stable suction temperature at a desired level. The by-pass valve 15 maintains the required flow of suction R-744 vapors through heat exchanger 12 in order to insure the required temperature of the suction vapors.

The compressors 2 are used for mechanical subcooling of the R-744 refrigerant leaving the cooler 11 through heat exchanger 3 or for heat reclaim through heat exchanger 4. Additional subcooling is provided for R-744 refrigerant leaving the receiver 14 by means of heat exchanger 43. The suction ports of compressors 2 are connected through motorized valves 9 and 44, and through conduits 26 and 48 to heat exchangers 3 and 43 or through motorized valve 10 and conduit 27 to heat exchanger 4.

When subcooling is required, valves 9 and 44 are open, and valve 10 is closed. Liquid R-744 is fed through conduits 23, 46 and 24 to expansion valves 8 and 45. The evaporation of the liquid R-744 in heat exchangers 3 and 43 absorbs heat from the R-744 refrigerant flowing through the other side of heat exchangers 3 and 43 (vapors in heat exchanger 3 and liquid in heat exchanger 43), thus reducing its temperature. The liquid R-744 is then fed through conduit 30 to throttling device 16 where its pressure and temperature are reduced to a level required for normal operation of the transcritical R-744 system 60 both at low and medium temperatures, and then is fed to receiver 17, which is operatively connected to the defrost compressors 18.

The evaporated R-744 refrigerant from heat exchangers 3 and 43 is fed through conduits 26 and 48, and through motorized valves 9 and 44 to the suction ports of compressors 2. The compressed R-744 vapors from compressors 2 are fed through heat exchanger 5 and conduit 39 to throttling device 6. From the throttling device 6 the R-744 vapors are fed through conduits 40 and 20 to cooler 11. The heat from the compressed R-744 vapors from compressors 2 is transferred in heat exchanger 5 to, for example, a glycol circulation system through conduits 41 and 42, and is used during the warm periods of the year for dehumidification purposes or water heating.

During colder periods of the year, where subcooling is not required, valves 8, 9, 44 and 45 are closed. Valves 7 and 10 are opened. Liquid R-744 is fed through conduits 23 and 47 to the expansion valve 7 and then to heat exchanger 4 where it evaporates and absorbs heat from the compressed R-744 vapors from compressors 1, which are fed through conduit 34, oil separator 31 and conduit 19 to heat exchanger 4.

The heat is then, by means of compressors 2, transferred in heat exchanger 5 to, for example, a glycol circulation system through conduits 41 and 42, and is used for comfort heating of the premises.

Energy Efficiency

By using mechanical subcooling as disclosed above with a transcritical R-744 refrigeration system 60, the EER may go up to, for example, about 9.27 compared to the EER of a typical transcritical R-744 refrigeration system 50, which is about 6.09. The compressors 2 used for the mechanical subcooling have an energy efficiency ratio of about 14.00 due to their favorable operating conditions.

It is clear that the mechanical subcooling of R-744 transcritical refrigeration systems eliminates their major disadvantage of having low energy efficiency.

During the cold periods of the year, a transcritical R-744 refrigeration system with mechanical subcooling 60 can operate as a subcritical R-744 refrigeration system 50 and its energy efficiency then becomes similar to the energy efficiency of a Freon refrigeration system when the ambient air temperature is lower than about 12° C. (53.6° F.). No mechanical subcooling should be required during these periods. What is important, however, is that there is need of heat recuperation for comfort heating of the premises. The R-744 will provide heat but at a low temperature level of around 70° F., which is not appropriate for space heating.

During these periods the compressors 2 used for subcooling operate as a heat pump extracting heat from the refrigeration compressors 1 and elevate this heat to usable temperatures for space heating.

Mechanical Subcooling System

The mechanical subcooling is provided by the mechanical subcooling system 62, which can be incorporated into existing R-744 refrigeration systems, and consists of compressors 2, heat exchangers 3, 4 and 43, valves 6, 7, 8, 9, 10, 13, 37, 44 and 45, and receiver 14.

Although the present disclosure has been described with a certain degree of particularity and by way of an illustrative embodiments and examples thereof, it is to be understood that the present disclosure is not limited to the features of the embodiments described and illustrated herein, but includes all variations and modifications within the scope and spirit of the disclosure as hereinafter claimed.

What is claimed is:

1. A mechanical subcooling system for use with a transcritical R-744 refrigeration system having at least one compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one compressor to provide the R-744 vapors to the at least one first compressor and to receive compressed R-744 vapors from the at least one first compressor, a by-pass valve for maintaining a required flow of R-744 vapors through the first heat exchanger, and a first receiver for receiving the R-744 vapors from the first throttling device, the first receiver being operatively connected to at least one defrost compressor, the mechanical subcooling system comprising:

a second heat exchanger operatively connected between the at least one first compressor and the cooler;

a third heat exchanger and a second throttling device operatively connected between the first heat exchanger and a second receiver for the separation of R-744 vapors and liquid;

a first pressure regulating valve for feeding R-744 vapors from the second receiver to the at least one first compressor;

at least one second compressor for mechanically subcooling of R-744 vapors leaving the cooler through the third heat exchanger or for heat reclaim through the second heat exchanger; and a fourth heat exchanger operatively connected between the second receiver and the at least one second compressor.

2. The mechanical subcooling system of claim 1, further comprising a third throttling device operatively connected between the at least one second compressor and the cooler.

3. The mechanical subcooling system of claim 1, the transcritical R-744 refrigeration system further including a fifth heat exchanger operatively connected between the at least one second compressor and the cooler for transferring heat to a circulation system to be used during warm periods for dehumidification purposes.

4. The mechanical subcooling system of claim 3, further comprising a third throttling device operatively connected between the fifth heat exchanger and the cooler.

5. The mechanical subcooling system of claim 1, further comprising:

a first motorized valve operatively connected between the third heat exchanger and the at least one second compressor;

a second motorized valve operatively connected between the fourth heat exchanger and the at least one second compressor; and a third motorized valve operatively connected between the second heat exchanger and the at least one second compressor.

6. The mechanical subcooling system of claim 5, wherein when subcooling is required, the first and the second motorized valves are open, and the third motorized valve is closed.

7. The mechanical subcooling system of claim 5, further comprising:

a first expansion valve operatively connected between the second receiver and the third heat exchanger;

a second expansion valve operatively connected between the second receiver and the fourth heat exchanger; and a third expansion valve operatively connected between the second receiver and the second heat exchanger.

8. The mechanical subcooling system of claim 7, wherein when subcooling is not required, the first and the second expansion valve, and the first and the second motorized valves are closed, and the third expansion valve and the third motorized valve are opened.

9. A transcritical R-744 refrigeration system having at least one first compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one first compressor to provide the R-744 vapors to the at least one first compressor and to receive compressed R-744 vapors from the at least one first compressor, a by-pass valve for maintaining a required flow of R-744 vapors through the first heat exchanger, a first receiver for receiving the R-744 vapors from the first throttling device, the first receiver being operatively connected to at least one defrost compressor, and a mechanical subcooling system as claimed in claim 1.

10. A transcritical R-744 refrigeration system having at least one first compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one first compressor to provide the R-744 vapors to the at least one first compressor and to receive compressed R-744 vapors from the at least one first compressor, a by-pass valve for maintaining a required flow of R-744 vapors through the first heat exchanger, a first receiver for receiving the R-744 vapors from the first throttling device, the first receiver being operatively connected to at least one defrost compressor, and a mechanical subcooling system as claimed in claim 2.

11. A transcritical R-744 refrigeration system having at least one first compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one first compressor to provide the R-744 vapors to the at least one first compressor and to receive compressed R-744 vapors from the at least one first compressor, a by-pass valve for maintaining a required flow of R-744 vapors through the first heat exchanger, a first receiver for receiving the R-744 vapors from the first throttling device, the first receiver being operatively connected to at least one defrost compressor, and a mechanical subcooling system as claimed in claim 3.

12. A transcritical R-744 refrigeration system having at least one first compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one first compressor to provide the R-744 vapors to the at least one first compressor and to receive compressed R-744 vapors from the at least one first compressor, a by-pass valve for maintaining a required flow of R-744 vapors through the first heat exchanger, a first receiver for receiving the R-744 vapors from the first throttling device, the first receiver being operatively connected to at least one defrost compressor, and a mechanical subcooling system as claimed in claim 4.

13. A transcritical R-744 refrigeration system having at least one first compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one first compressor to provide the R-744 vapors to the at least one first compressor and to receive compressed R-744 vapors from the at least one first compressor, a by-pass valve for maintaining a required flow of R-744 vapors through the first heat exchanger, a first receiver for receiving the R-744 vapors from the first throttling device, the first receiver being operatively connected to at least one defrost compressor, and a mechanical subcooling system as claimed in claim 5.

14. A transcritical R-744 refrigeration system having at least one first compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one first compressor to provide the R-744 vapors to the at least one first compressor and to receive compressed R-744 vapors from the at least one first compressor, a by-pass valve for maintaining a required flow of R-744 vapors through the first heat exchanger, a first receiver for receiving the R-744 vapors from the first throttling device, the first receiver being operatively connected to at least one defrost compressor, and a mechanical subcooling system as claimed in claim 6.

15. A transcritical R-744 refrigeration system having at least one first compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one first compressor to provide the R-744 vapors to the at least one first compressor and to receive compressed R-744 vapors from the at least one first compressor, a by-pass valve for maintaining a required flow of R-744 vapors through the first heat exchanger, a first receiver for receiving the R-744 vapors from the first throttling device, the first receiver being operatively connected to at least one defrost compressor, and a mechanical subcooling system as claimed in claim 7.

16. A transcritical R-744 refrigeration system having at least one first compressor for compressing R-744 vapors directed to a cooler operatively connected to a first throttling device, for reducing the pressure and temperature of the R-744 vapors to a level required for the normal operation of the R-744 refrigeration system, through a first heat exchanger, the first heat exchanger being operatively connected to the at least one first compressor to provide the R-744 vapors to the at least one first compressor and to receive compressed R-744 vapors from the at least one first compressor, a by-pass valve for maintaining a required flow of R-744 vapors through the first heat exchanger, a first receiver for receiving the R-744 vapors from the first throttling device, the first receiver being operatively connected to at least one defrost compressor, and a mechanical subcooling system as claimed in claim 8.

* * * * *